US007913461B2

(12) United States Patent
Travez et al.

(10) Patent No.: US 7,913,461 B2
(45) Date of Patent: Mar. 29, 2011

(54) STRUCTURAL SYSTEMS

(75) Inventors: Italo D. Travez, Ashburn, VA (US); Jose V. Travez, Falls Church, VA (US); Bryan Ramos, Ashburn, VA (US)

(73) Assignee: Prototype Productions, Inc., Ashburn, VA (US)

( * ) Notice: Subject to any disclaimer, the term of this patent is extended or adjusted under 35 U.S.C. 154(b) by 1299 days.

(21) Appl. No.: 11/399,648

(22) Filed: Apr. 7, 2006

(65) Prior Publication Data

US 2007/0033883 A1 Feb. 15, 2007

Related U.S. Application Data

(60) Provisional application No. 60/668,972, filed on Apr. 7, 2005.

(51) Int. Cl.
*E04H 6/00* (2006.01)

(52) U.S. Cl. ..... 52/79.5; 348/14.01; 340/573.1

(58) Field of Classification Search ..... 52/36.2, 52/79.5, 36.1

See application file for complete search history.

(56) References Cited

U.S. PATENT DOCUMENTS

| | | | | |
|---|---|---|---|---|
| 3,983,583 | A * | 10/1976 | Herman et al. | 62/331 |
| 3,984,637 | A | 10/1976 | Caudill et al. | |
| 5,365,704 | A | 11/1994 | Ray | |
| 5,429,432 | A * | 7/1995 | Johnson | 312/235.3 |
| 5,567,164 | A * | 10/1996 | Durkin et al. | 434/432 |
| 5,897,325 | A * | 4/1999 | Koby-Olson | 434/432 |
| 6,053,792 | A * | 4/2000 | Sallee et al. | 446/81 |
| 6,116,757 | A | 9/2000 | Simon | |
| 6,202,361 | B1 | 3/2001 | Thorp et al. | |
| 6,205,716 | B1 * | 3/2001 | Peltz | 52/36.2 |
| 6,507,962 | B2 | 1/2003 | Thurston | |
| 6,701,682 | B2 * | 3/2004 | Ando et al. | 52/234 |
| 6,980,259 | B2 * | 12/2005 | Strollo et al. | 348/836 |
| 6,983,567 | B2 | 1/2006 | Ciotti | |
| 2002/0073632 | A1 | 6/2002 | Huffman | |

OTHER PUBLICATIONS

International Search Report dated Dec. 13, 2007 (Ten (10) pages).

* cited by examiner

*Primary Examiner* — Curtis Kuntz
*Assistant Examiner* — Maria El-Zoobi
(74) *Attorney, Agent, or Firm* — Patton Boggs LLP

(57) ABSTRACT

A structural system for use in areas in which space is valuable. The structural system is a self-contained meeting center capable of transforming from a closed storage position into an open position for conducting a meeting. The structural system may be used for interior and exterior applications. The structural system may also include a mobile, micro-climate controlled chair system.

15 Claims, 4 Drawing Sheets

Closed Position

STRUCTURAL SYSTEMS

FIELD OF THE INVENTION

The present invention relates to structural systems.

BACKGROUND OF THE INVENTION

The hospitality industry is constantly searching for ways to better utilize space. The economics is simple. The more square footage of useable space, the more revenue. The inventors of the present application have identified areas of space that are currently "wasted" in many environments and have developed structural systems that effectively turn unused spaces into revenue producing machines. These environments include the non-revenue generating space found in the space between a floor and ceiling (mezzanine area).

SUMMARY OF THE INVENTION

One embodiment of the present invention is a structural system. The structural system has the ability to transform from a first structure in a closed position into a second structure in an open position. The pod can be used for meetings and is a self-contained media and communication center.

Another embodiment of the present invention is a mobile, micro-climate controlled chair system. The chair system is equipped with monitoring and communication systems. The chair system provides a safe and comfortable environment for outdoor lounging.

DETAILED DESCRIPTION OF THE INVENTION

For simplicity and illustrative purposes, the principles of the present invention are described by referring to various exemplary embodiments thereof. Although the preferred embodiments of the invention are particularly disclosed herein, one of ordinary skill in the art will readily recognize that the same principles are equally applicable to, and can be implicated in other compositions and methods, and that any such variation would be within such modifications that do not part from the scope of the present invention. Before explaining the disclosed embodiments of the present invention in detail, it is to be understood that the invention is not limited in its application to the details of any particular embodiment shown, since of course the invention is capable of other embodiments. The terminology used herein is for the purpose of description and not of limitation. Further, although certain methods are described with reference to certain steps that are presented herein in certain order, in many instances, these steps may be performed in any order as may be appreciated by one skilled in the art, and the methods are not limited to the particular arrangement of steps disclosed herein. Further, although certain embodiments are shown in the figures, the present invention is certainly not intended to be limited to these portrayed embodiments.

One embodiment of the present invention is drawn towards a structural system. The system is preferably foldable or able to change shape. One embodiment of the system is for internal use in hotels. The system can initially serve as a chandelier for a lobby of a hotel. If desired the system can be lowered and "unfolded" into a pod or meeting center.

Figure 1:
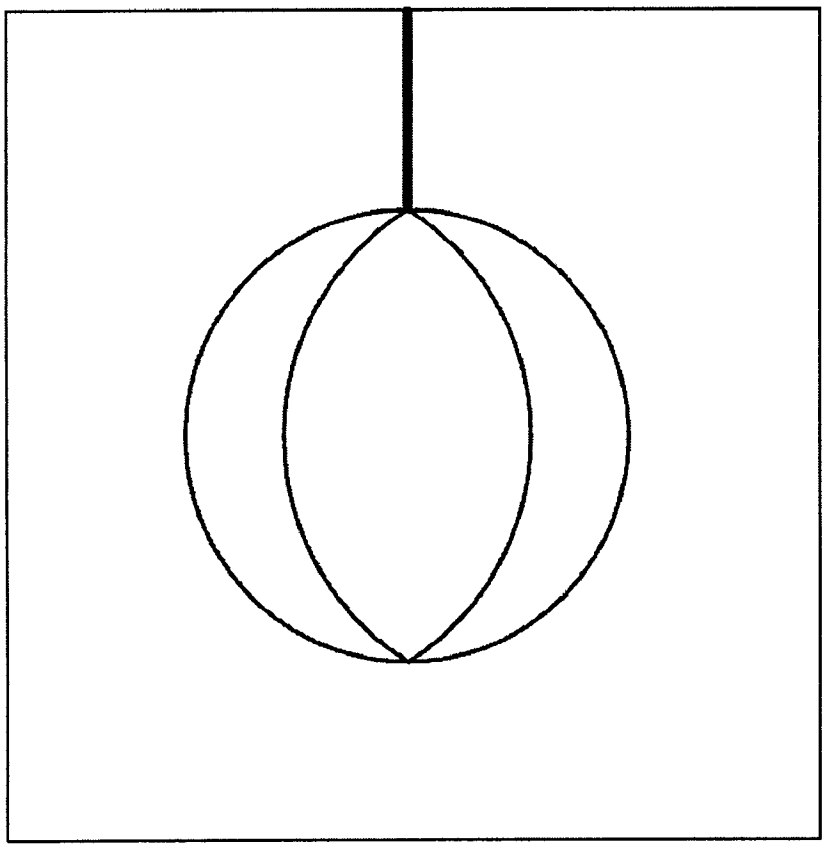
FIG. 1 shows an embodiment of the invention in a closed position.

FIGS. 1-5 show embodiments of the invention for use in hotels or other inside uses. FIG. 1 shows an embodiment of the structural system in a closed position. The structural system could be stored in this manner. In one embodiment of the invention, the structural system could serve as a functional or non-functional chandelier in storage state. In another embodiment of the invention, the structural system could retract into the ceiling or floor and be hidden from view in storage state.

Figure 2:
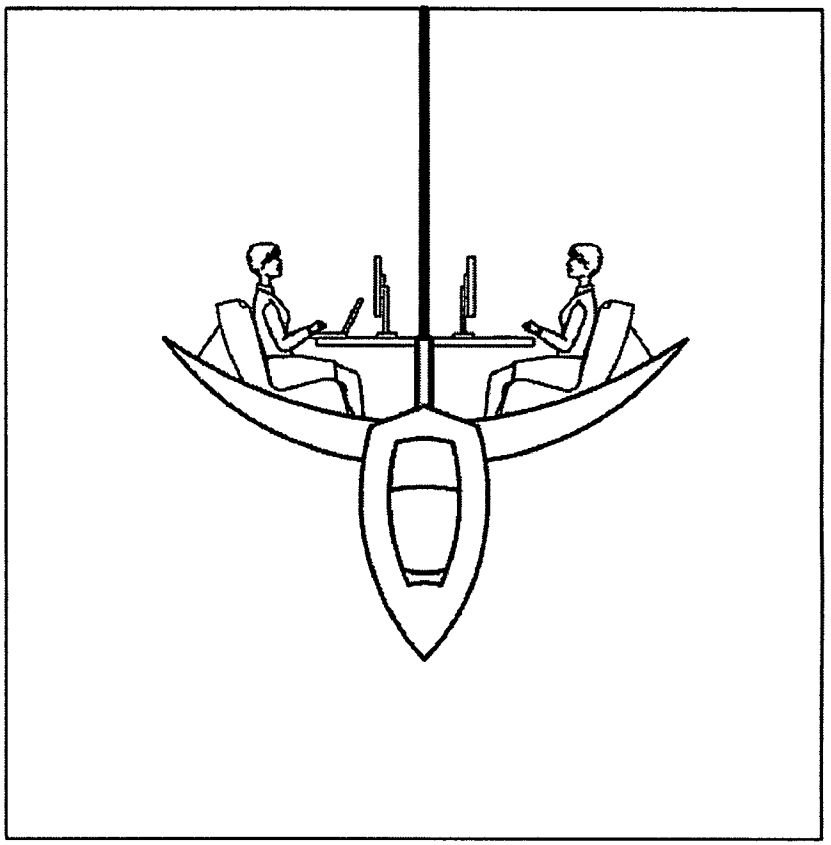
FIG. 2 shows an embodiment of the invention in an open position.
Figure 3:
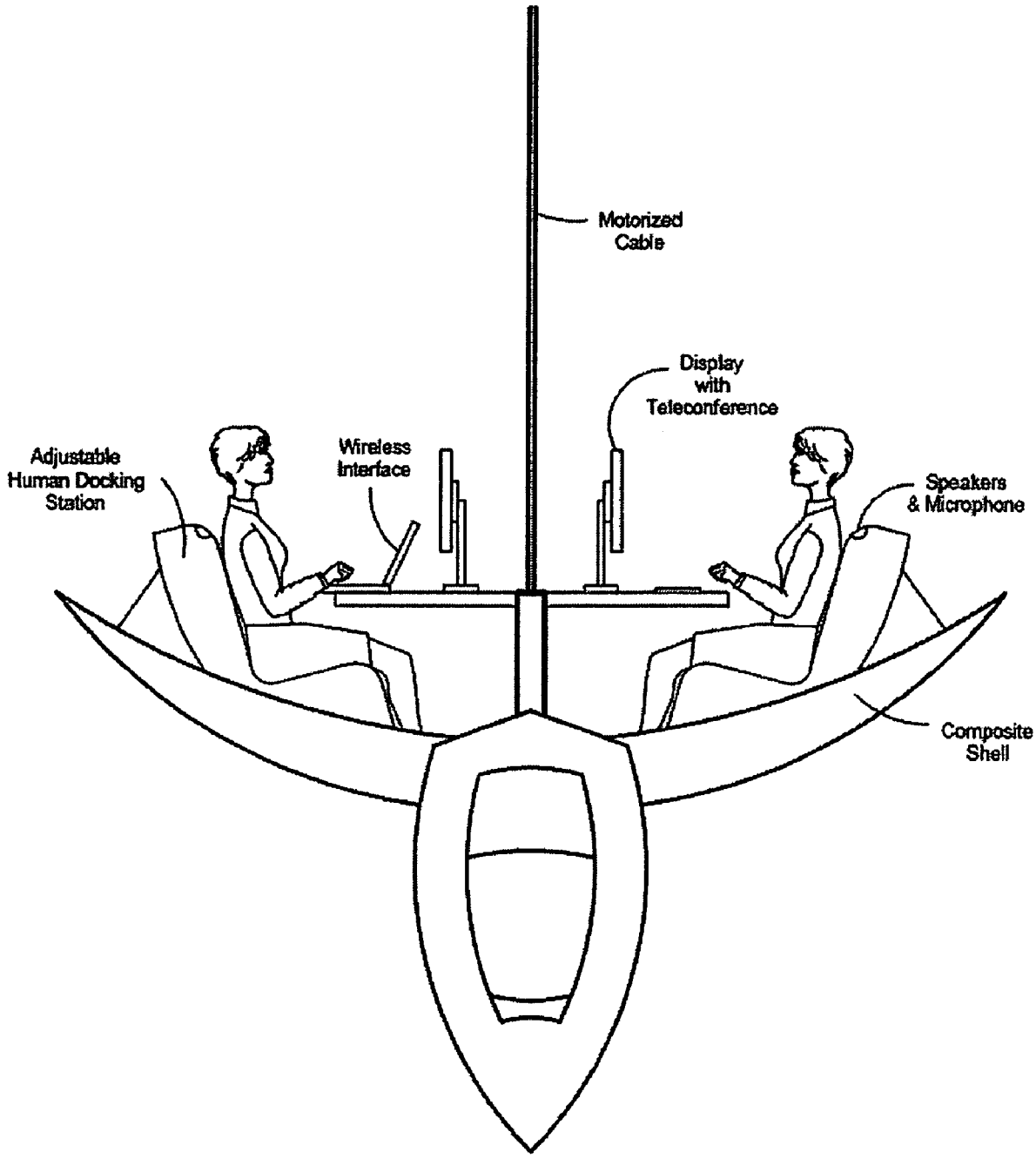
FIG. 3. shows a more detailed embodiment of the invention in an open position.

FIG. 2 shows an embodiment of the structural system in an unfolded or open state. The unfolded structural system of the present invention provides a built environment that allows groups of people to engage in and digitally capture impromptu or organized meetings. In addition, the structural system of the present invention could be designed for social and recreational gatherings. Current communication technologies built into the structural system include touch screen LCD displays, audio/video capture devices with the ability to create transcripts from spoken words, tablet displays with OCR (Optical Character Reference), video conferencing equipment, and wireless communication systems. The system could also include next generation communication tools such as hologram projections for 3D-visualization and flexible displays. FIG. 3 shows a more detailed view of the structural system in an open position. Although the system shown only accommodates two people, the structural system could be designed to accommodate more people at one time. This capacity would only be limited by the size and weight of the structural system.

Figure 4:
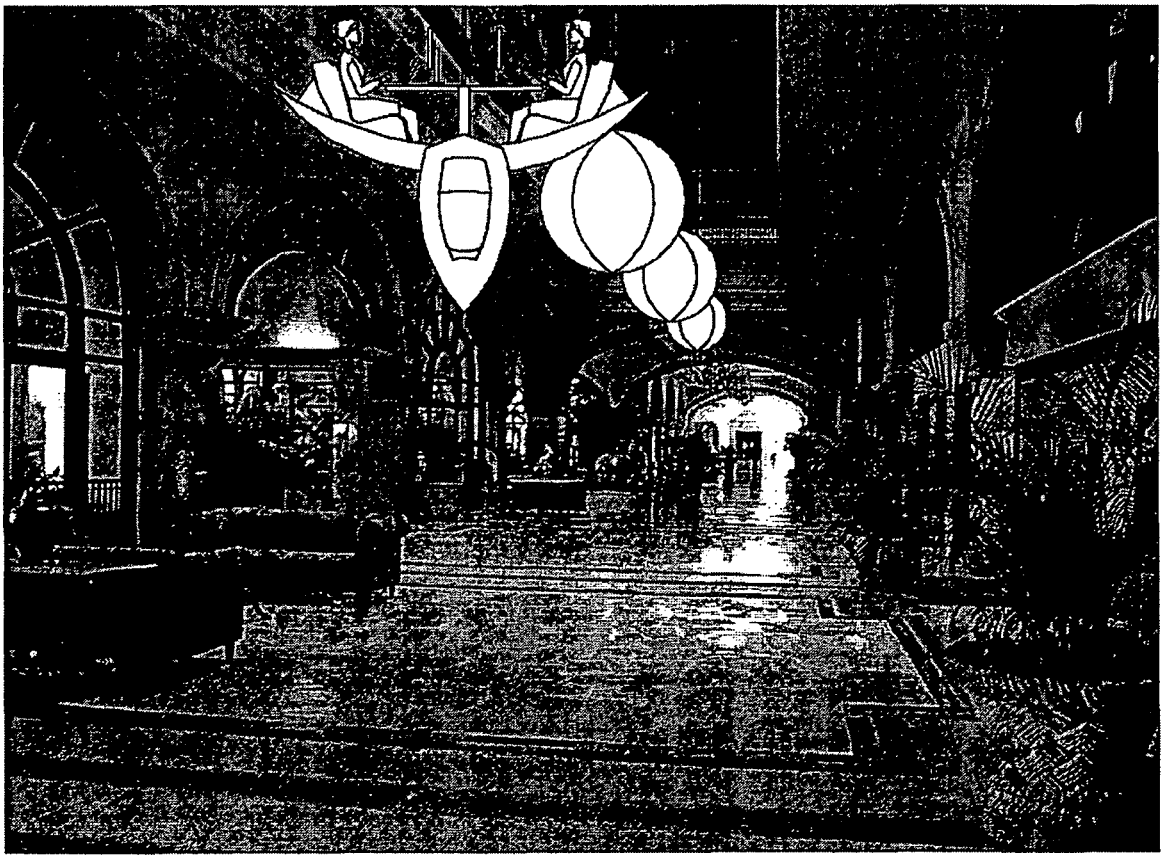
FIG. 4 shows an embodiment of the invention in an open position in use and an embodiment of the invention in a closed position in storage.

FIG. 4 shows an embodiment of the invention in use and shows several structural systems in closed, storage positions. As can be seen, the structural system can be used elevated off the ground floor of the hotel lobby. This allows hotel proprietors to take advantage of unused space and further generate revenue.

Figure 5:
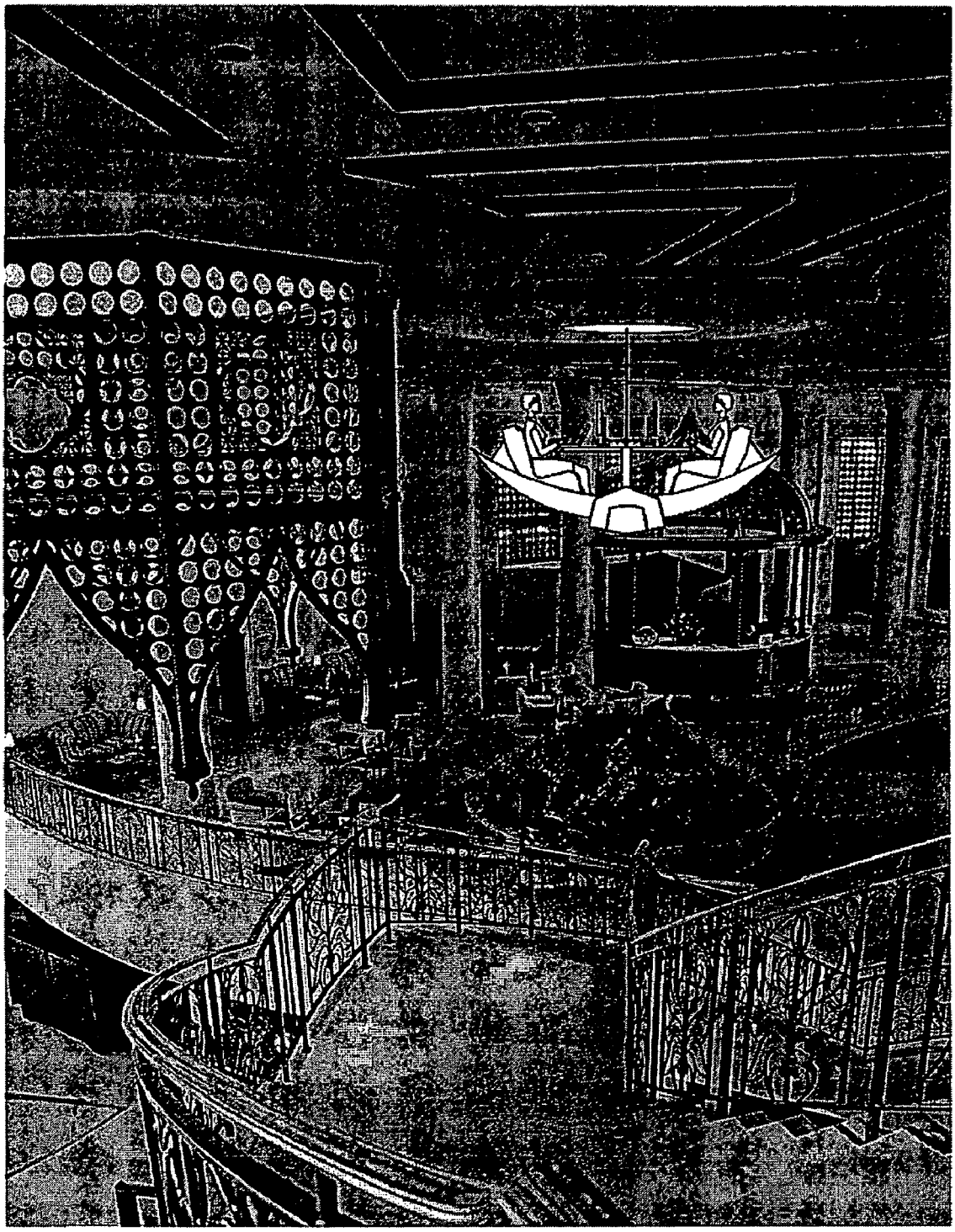
FIG. 5 shows an embodiment of the invention that is retractable into a ceiling in an open position in use.

FIG. 5 also depicts an embodiment of the invention in use in an open position elevated from the floor. The embodiment shown in FIG. 5 is also retractable into the ceiling. In this embodiment, the structural system would be stored out of view of the hotel guests.

The structure can be raised or lowered via any current manual, mechanical, hydraulic, and compressed air systems or any other systems that are commonly used in z-axis movement applications. Future systems might include magnetic levitation and others. Another embodiment of the structural system has the ability to move in the x, y, and z axis.

In one embodiment of the structural system, the system is a chassis-based structure with a modular and interchangeable shell that houses seating, equipment, and work surfaces. All the components are modular and can adapt to market-driven aesthetics and needs. Ideally the structural system will be constructed of advanced composites and fabrics, but can also be constructed out of traditional materials such as metal, wood, and plastic. The structural system can be assembled using traditional fasteners such as nuts and bolts, or can be assembled using advances in hardware such as quick fasten/release nuts and bolts. For reconfiguring the structural system, these advanced fasteners provide the flexibility to make un-assembly and re-assembly easy and efficient.

The user will have the ability to interact with the structural system through various interface devices including touch-screen displays, traditional mouse and keyboard, and wireless systems. Preferably, the structural system and all its functions will be controlled via a device (remote or stationary control) based on force feedback technology.

The structural system of the present invention will also work in complimentary fashion with the pre-fabricated structures disclosed in pending U.S. patent application Ser. No. 10/163,610 entitled "Structure Having Preinstalled Utilities and Amenities", which is hereby incorporated by reference in its entirety. The prefabricated structures will be able to "plug" into the structural system of the present invention and become an integral system.

The primary use of the present invention is in hotels. However, the structural systems of the present invention could be deployed in any environment where meetings occur including but not limited to airplanes, airports, offices, resorts, trains, train stations, buses, bus stations, malls, restaurants, homes, vehicles, movie theaters, boats, ships, and nightclubs. The structural system and available utilities and amenities would be adapted to market requirements.

In its primary use in hotels, the structural system would make use of non-revenue generating space found in the space between a floor and ceiling (mezzanine area). It could be located anywhere throughout the hotel's public spaces but ideally be situated in lobbies, pre-function, and function areas. In one embodiment, the structural system is a chandelier form factor that can be suspended and lowered from a ceiling. The number of structural systems possible in a given space such as a hotel lobby is limited only by available space. For instance, a typical hotel lobby may have fifty or more "chandeliers." The structural system could also partially or completely retract into the ceiling.

The structural system could be used by business people who need to meet to present, review, and document data as well as groups meeting for entertainment, socializing, or small parties. The structural system could be lowered from its elevated "storage" position and lowered onto the floor of the hotel lobby, for example, when requested by a user or group of users. The system could then be unfolded or opened. The preinstalled utilities and amenities would provide a self-contained meeting environment wherein telecommunications and other equipment would be integral and would not have to be brought in or retrieved from outside of the structural unit. The system could then be elevated off the floor if desired or remain on the floor for a lobby level meeting. The users could be charged an hourly fee for use of the structural system. Of course, any kind of arrangement between the hotel and the user could be used for use of the system.

In a second embodiment, the structural system retracts into the ground or is manually or mechanically moved into a storage compartment. The primary users for this embodiment would also be business people. The structural system could also be integrated in the hotel lobby wall or any other wall. In this embodiment, the system would "unfold" from the wall to provide a self-contained meeting environment and then retract into the wall. In another embodiment, a single wall could contain a plurality of structural systems. The structural systems could be stacked on each other inside the wall and a particular system could be selected by rearranging the configurations of the systems so that the desired system was at the lobby level. The structural system could then be used at the floor level or elevated off the ground. This would allow several systems in use to be jutting out from a single wall at a given time.

In another embodiment, the structural system is an exterior system that is suspended in the air atop a structural post or column. This exterior system has the ability to move up and down the post it is attached to as well as rotate and tilt. This external system could be used in a resort. For example, users desiring to sunbathe in privacy could rent the system and then be elevated away from a public place such as a swimming pool. In this embodiment, the system could have the external appearance of a palm tree or other kind of plant life. The "trunk" of the tree could be the post or column which has the ability to raise and lower the structural system in a telescoping fashion. The post could also retract into the ground upon lowering the structural system. The structural system could include "palm leafs" to provide additional privacy. The external system could be used by people looking to socialize by creating an environment such as a private party with full service bar elevated in the air.

In each embodiment, equipment, amenities, and utilities necessary to serve the needs of its target audience whether they be business, social, entertainment, or a combination would be integrated into the structural system. As noted previously, the business structural system will provide ease of use for people engaging in business related meetings and provide the tools necessary to execute and capture business data. The social and entertainment structural system will focus on creating a comfortable environment with micro climates and amenities such as mist sprayers, aromatherapy, music, and suntan lotion dispensers for sun bathers. The structural system will also provide a point of sales interface that would allow the user to purchase services, products, and information.

In another embodiment of the present invention, the structural system is a chair that is a mobile, micro-climate controlled environment designed to enhance the outdoor lounging experience. The chair combines a traditional poolside lounge chair with innovative features such as integrated massage, displays, sensors that track sun position to increase or decrease UV exposure, aromatherapy, mist systems that dispense water vapor, aloe, or suntan lotion. The user can specify the desired SPF of the lotion. The chair is also rotatable and a user can specify a certain amount of UV exposure. The chair may be programmed to automatically track the pattern of the sun to provide constant UV exposure. In this way, loungers and sunbathers would not have to be concerned with the annoying task of always trying to orientate their chair in the best possible angle with regards to the sun. The chair also includes display systems for entertainment as well as to order amenities, services, and products. For example, a hotel menu could be displayed for ordering food and beverages. The chair may also include any media systems such as computers with internet access, televisions, satellite radios, radios, CD players, DVD players, MP3 players, VCR players, or any other audio or visual media. The chair may also include storage and refrigeration systems that allow a user to have quick access to food and beverages. The chair may also include cooking systems such as a gas or charcoal grill.

In conjunction with the displays, the chair further includes sensors that monitor UV exposure, body temperature, and humidity levels to insure a safe lounging experience. The primary purpose of the structural system chair is to provide a comfortable and safe environment for outdoor lounging. The chair has the ability to transfer a user's personal data to another display. For example, for use in a hotel or resort, the user's data could be transferred to the front desk so that the hotel or resort could monitor a customer's UV exposure to help prevent a negative resort experience caused by sunburn, dehydration, or other physical ailment.

Although certain embodiments of the invention have been described, the invention is not meant to be limited in any way to just these embodiments. For example, although the above description is largely directed towards use of the structural systems in hotels, the structural systems can be used in any environment where meetings or social gatherings are desired including but not limited to airplanes, airports, offices, resorts, trains, train stations, buses, bus stations, malls, restaurants, homes, vehicles, movie theaters, boats, ships, and nightclubs. Further, although only a certain shape of the structural system is shown in the figures in a closed position and an open position, the present invention can take any shape or configuration.

What is claimed is:

1. A self-contained meeting center comprising:

a unitary enclosure, which substantially encloses a predetermined volume of space when in a closed position and which is deployable into an open position which enables access to said predetermined volume of space without the use of enclosing walls, comprising:

a plurality of enclosure segments which mate together when in said closed position to form an outer shell for substantially enclosing said predetermined volume, and wherein said at least two of said plurality of enclosure segments are oriented in a substantially horizontal position when the unitary enclosure is deployed in the open position to enable access to said predetermined volume of space; and a set of furnishings located in said predetermined volume of space, where access to said set of furnishings is provided without the use of enclosing walls and wherein said set of furnishing comprises at least one of the elements selected from the group consisting of: user seating, communication equipment, power and wireless technology, and preinstalled utilities.

2. The self-contained meeting center of claim 1 wherein the preinstalled utilities comprise at least one of the elements selected from the group consisting of: touch screen LCD displays, speech recognition devices, tablet displays with Optical Character Reference, video conferencing equipment; and wireless communication systems.

3. The self-contained meeting center of claim 1 further comprising preinstalled amenities.

4. The self-contained meeting center of claim 1 wherein the unitary structure is substantially prolate spheroid in shape when in the closed position.

5. The self-contained meeting center of claim 1 wherein the first structure in the closed position has the appearance of a chandelier.

6. The self-contained meeting center of claim 1 wherein the first structure in the closed position comprises a fully functional chandelier.

7. The self-contained meeting center of claim 1 wherein the meeting center is constructed from at least one of the materials selected from the group consisting of: advanced composites, recycled materials, metal, wood, and plastic.

8. A method of providing a-self-contained meeting center, said method comprising:

providing a unitary enclosure, consisting of a plurality of wall segments which substantially enclose a predetermined volume of space when in a closed position, and which contains a set of furnishings located in said predetermined volume of space;

unfolding the unitary enclosure into an open position to enable access to said predetermined volume of space and its set of furnishings without the use of enclosing walls;

wherein said at least two of said plurality of enclosure segments are oriented in a substantially horizontal position when the unitary enclosure is deployed in the open position to enable access to said predetermined volume of space.

9. The method of providing a-self-contained meeting center of claim 8 wherein the step of providing a self-contained meeting center comprises the use of at least one of the elements selected from the group consisting of: touch screen LCD displays, speech recognition devices, tablet displays with Optical Character Reference, video conferencing equipment, power, and wireless communication systems.

10. The method of providing a self-contained meeting center of claim 8 wherein the step of providing a self-contained meeting center provides a unitary structure that is substantially prolate spheroid in shape when in the closed position.

11. The method of providing a self-contained meeting center of claim 8 further comprising:

entering the predetermined volume of space in the open position from the floor of a building.

12. The method of providing a self-contained meeting center of claim 11 further comprising:

raising the self-contained meeting center while it is deployed in the open position above the floor of the building to a predetermined height.

13. The method of providing a self-contained meeting center of claim 8 wherein the step of providing comprises:

opening a space in the ceiling of a building; and lowering the self-contained meeting center through the space.

14. The method of providing a self-contained meeting center of claim 8 wherein the step of providing comprises:

lowering the self-contained meeting center from a position in the space between the ceiling and floor of a building to the floor of the building.

15. The method of providing a self-contained meeting center of claim 8 wherein the step of providing comprises:

opening a space in the floor of a building; and raising the self-contained meeting center through the space.

* * * * *